US007106983B2

(12) United States Patent
Nakayama et al.

(10) Patent No.: US 7,106,983 B2
(45) Date of Patent: Sep. 12, 2006

(54) COLOR IMAGE FORMING APPARATUS

(75) Inventors: Masayoshi Nakayama, Ibaraki (JP); Teruaki Mitsuya, Ibaraki (JP); Hisao Okada, Ibaraki (JP); Keisuke Kubota, Ibaraki (JP); Takashi Rokutanda, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 62 days.

(21) Appl. No.: 10/916,618

(22) Filed: Aug. 12, 2004

(65) Prior Publication Data

US 2005/0063721 A1 Mar. 24, 2005

(30) Foreign Application Priority Data

Sep. 18, 2003 (JP) ..... P2003-326908

(51) Int. Cl.
*G03G 15/00* (2006.01)

(52) U.S. Cl. ..... 399/49; 399/39; 399/51; 399/46

(58) Field of Classification Search ..... 399/49
See application file for complete search history.

(56) References Cited

U.S. PATENT DOCUMENTS 5,950,042 A * 9/1999 Goto et al. ..... 399/49
6,686,943 B1 * 2/2004 Ishii et al. ..... 399/49
2003/0091356 A1 * 5/2003 Komatsu et al. ..... 399/49

FOREIGN PATENT DOCUMENTS

| | | |
|---|---|---|
| JP | 63-240569 | 10/1988 |
| JP | 11-15214 | 1/1999 |
| JP | 2001-358955 | 12/2001 |

* cited by examiner

*Primary Examiner*—Arthur T. Grimley
*Assistant Examiner*—Ryan D. Walsh
(74) *Attorney, Agent, or Firm*—McGinn IP Law Group, PLLC

(57) ABSTRACT

A color image forming apparatus includes a developing unit to which a developing bias with an AC component superposed is applied, wherein the DC voltage of the developing bias is adjusted to set the detected density of a solid image at a specified value, the light amount of radiation for exposing an image area having a width of a few dots adjacent to the white paper is adjusted to set the detected density of an image developed under a peripheral electric field at a specified value, and the gradation density curve is regulated by alternately adjusting the DC voltage, the light amount of radiation for exposing the image area having a width of a few dots adjacent to the white paper, and the amplitude of the AC component until the detected density of a mesh point image having an area ratio from 60 to 80% falls within a specified range.

2 Claims, 8 Drawing Sheets

COLOR IMAGE FORMING APPARATUS

BACKGROUND OF THE INVENTION

1. Field of the Invention

The present invention relates to an image forming apparatus of electrophotographic method in which a latent image is visualized employing colored particles such as a toner in a printer, a facsimile or a copying machine, and more particularly to a color image forming apparatus having a plurality of image forming means.

2. Description of the Related Art

One type of the color image forming apparatuses is a tandem system in which image forming means including of a photoconductor, a charger, an exposure unit, a developing unit, and a cleaner is provided for each color of black (K), yellow (Y), magenta (M) and cyan (C), and a toner image formed by each image forming means is transferred onto the paper or an intermediate transfer body to form a color image.

In the case where a color image is produced by mixing a plurality of color toners subtractively, the hue of the final color image may be changed if a gradation density curve of each color toner image is varied. Therefore, it is required to keep the gradation density curve stable for each image forming means in the color image forming apparatus of tandem system. The variable factors of the gradation density curve include a variation in the developing gap, a change in the exposure sensitivity of photoconductor, a change in the film thickness of photoconductor, the charge amount of developer, and a change in the resistance of developer.

A conventional method has been well known in which prior to the image formation, a test patch latent image is formed on the photoconductor by the exposure unit, and developed by the developing unit to form a test patch image, a reflection density (image density) of the test patch image is measured by an optical image density sensor, and if the reflection density (image density) is deviated from a specified value, a developing bias, a grid voltage of the charger, and the supply of toner are controlled (refer to JP-A-63-240569).

A method for correcting for a variation in the developing electric field is well known, including detecting a potential on the surface of photoconductor by a potential sensor, detecting a film thickness of photoconductor in some way, changing a light amount of laser to keep the developing electric field constant, and controlling the potential on the surface of photoconductor, for example, as described in JP-A-11-15214.

However, with the conventional technique as above described, the image density of a solid area (solid image portion) that is mainly developed due to a parallel electric field may be corrected, but a variation in the gradation density curve caused by a variation in the peripheral electric field can not be corrected, resulting in a problem that the hue of color image may be varied for each apparatus or with the passage of time.

Conventionally, a method has been offered in which when the hue of color image is changed, the hue of an output test pattern is read into the control portion of the image forming apparatus by a scanner, and the raster expansion of input image data is modified to correct for a variation in the hue of the color image (refer to JP-A-2001-358955).

SUMMARY OF THE INVENTION

However, with the previous method, there was a problem that the normal printing job must be stopped every time of correction, resulting in the lower productivity of printed matter.

It is an object of the invention to solve the above-mentioned problems associated with the prior art, and provide a color electrophotographic printing apparatus with less variation in the hue of color image and with high productivity of printed matter.

To accomplish the above object, this invention provides a color image forming apparatus which comprises a developing unit to which a developing bias with an AC component superposed is applied, wherein the DC voltage of the developing bias is adjusted so that the detected density of a solid image may be set at a specified value, the light amount of radiation for exposing an image area having a width of a few dots adjacent to the white paper portion is adjusted so that the detected density of an image developed under a peripheral electric field may be set at a specified value, and the gradation density curve is regulated by alternately adjusting a DC voltage of the developing bias, the light amount of radiation for exposing the image area having a width of a few dots adjacent to the white paper portion, and the amplitude of the AC component until the detected density of a mesh point image having a dot occupied area ratio from 60 to 80% may fall within a specified range, so that a plurality of image forming means have less different gradation density curves from one image forming means to another.

According to this invention, it is possible to provide a color image forming apparatus with less variation in the hue of a color image and with high productivity of printed matter.

DETAILED DESCRIPTION OF THE PREFERRED EMBODIMENTS

The preferred embodiments of the present invention will be described below with reference to the accompanying drawings.

Figure 1:
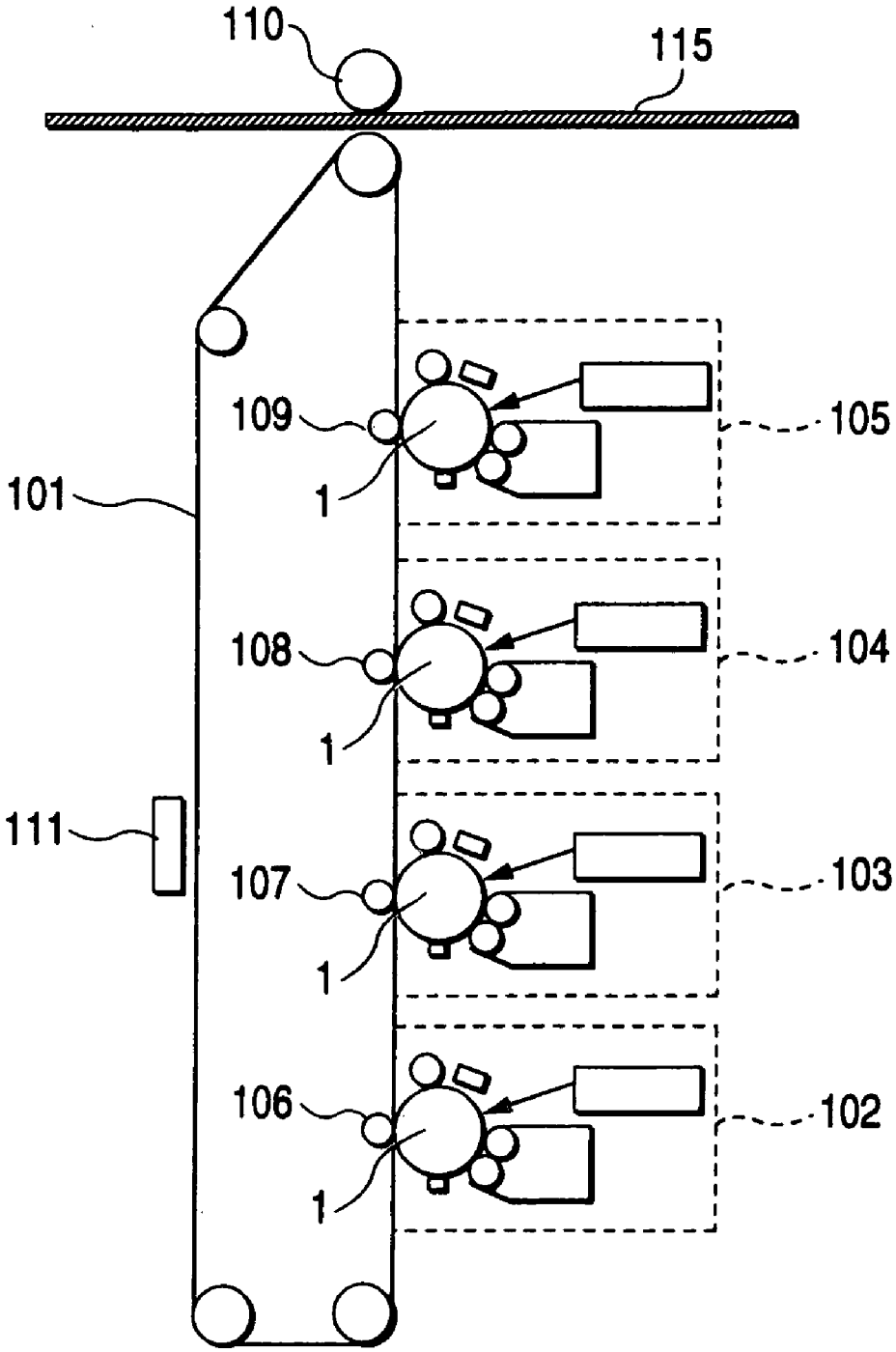
FIG. 1 is a schematic view of a color image forming apparatus according to an embodiment of the invention.

FIG. 1 is a schematic view showing, in cross section, a color image forming apparatus according to an embodiment of the invention.

In FIG. 1, reference numeral 101 denotes an intermediate transfer belt, 102 to 105 denote image forming means for yellow (Y), magenta (M), cyan (C) and black (K) disposed in a rotational direction of the intermediate transfer belt 101, 109 denotes a first transfer unit provided corresponding to each of the image forming means 102 to 105, 110 denotes a second transfer unit opposed to the intermediate transfer belt 101 via a paper 115, and 111 denotes a belt cleaner. Herein, the image forming means 102 to 105 have the same constitution, but are only different in colors for use.

Figure 2:
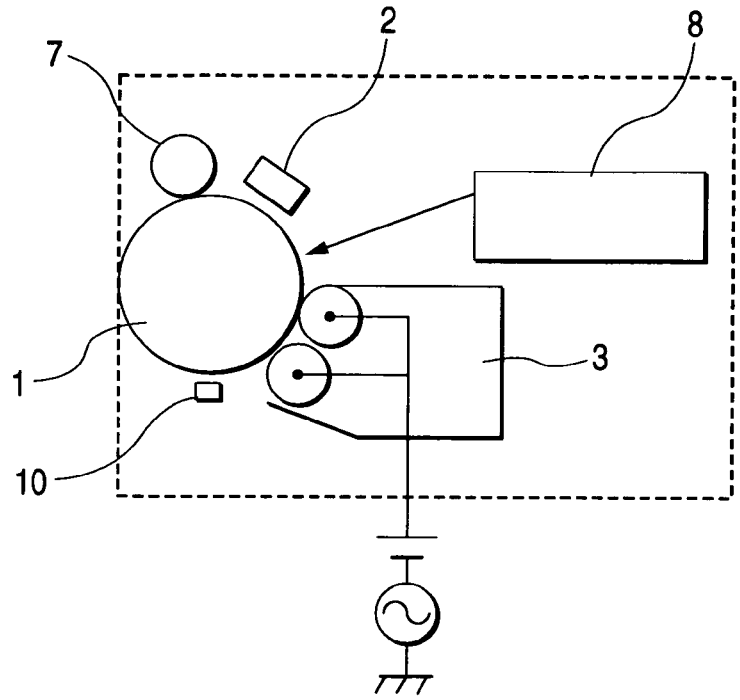
FIG. 2 is a schematic view of each image forming means for use in the color image forming apparatus.

FIG. 2 is a schematic view of each image forming means as seen from the side face. Reference numeral 1 denotes a photographic drum, 2 denotes a Scorotron charger, 3 denotes a developing unit, 7 denotes a cleaner, 8 denotes an exposure unit, and 10 denotes an optical image density sensor disposed downstream of the developing unit 3 in the rotational direction of the photographic drum.

Each of the image forming means 102 to 105 forms a latent image on the surface of the photographic drum 1 charged uniformly by the Scorotron charger 2 at a resolution of 600 dpi by the exposure unit 8, based on an image signal.

Thereafter, the developing unit 3 develops the latent image by applying a developing bias with an AC voltage superposed on the DC voltage. The frequency of AC voltage superposed for the developing bias is from 2 to 16 kHz, the amplitude Vpp is preferably from 0.4 to 2.0 kV, and the waveform is a rectangular wave, sinusoidal wave, or triangular wave. A toner developed on the surface of the photographic drum 1 is sequentially transferred onto the intermediate transfer belt 101 by the first transfer units 106 to 109, then transferred onto the paper 115 by the second transfer unit 110, and melted and fixed on the paper 115 by a fixing unit, not shown, to produce a final color image.

A residual toner on the intermediate transfer belt 101 is withdrawn by the belt cleaner 111. Also, a residual toner remaining on the photographic drum 1 without being transferred onto the intermediate transfer belt 101 is withdrawn by the cleaner 7 (see FIG. 2).

In this embodiment, a test patch latent image of predetermined image pattern is formed on the photographic drum 1 by the exposure unit 8, and developed by the developing unit 3 to produce a test patch image. Thereafter, the reflection density of the test patch image is sensed by the optical image density sensor 10, and the grid voltage Vg of the Scorotron charger, the DC voltage of developing bias, and the amplitude Vpp of AC voltage are adjusted based on a sensed value by a main control unit. The optical image density sensor 10 employs a regular reflected light in the image forming means of black (K), and a diffuse reflected light in the image forming means of yellow (Y), magenta (M) and cyan (C).

Figure 3:
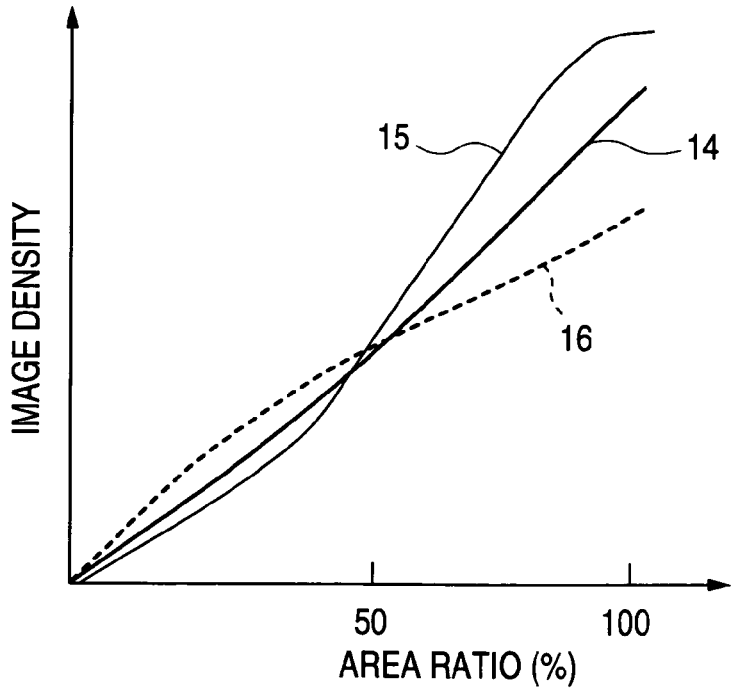
FIG. 3 is a characteristic curve showing a variation in the gradation density curve when the developing gap is varied.

Then, a variation in the gradation density curve for each image forming means will be described below. FIG. 3 is a characteristic curve showing a variation of the gradation density curve when the developing gap is varied. The transverse axis represents a dot occupied area ratio and the longitudinal axis represents an image density. The dot occupied area ratio indicates a percentage of area occupied by dots in a certain area of the image data, and hereinafter abbreviated to as an area ratio.

In FIG. 3, a curve 14 is a gradation density curve when the developing gap is proper, a curve 15 is a gradation density curve when the developing gap is narrower than the proper value, and a curve 16 is a gradation density curve when the developing gap is wider than the proper value.

Figure 4:
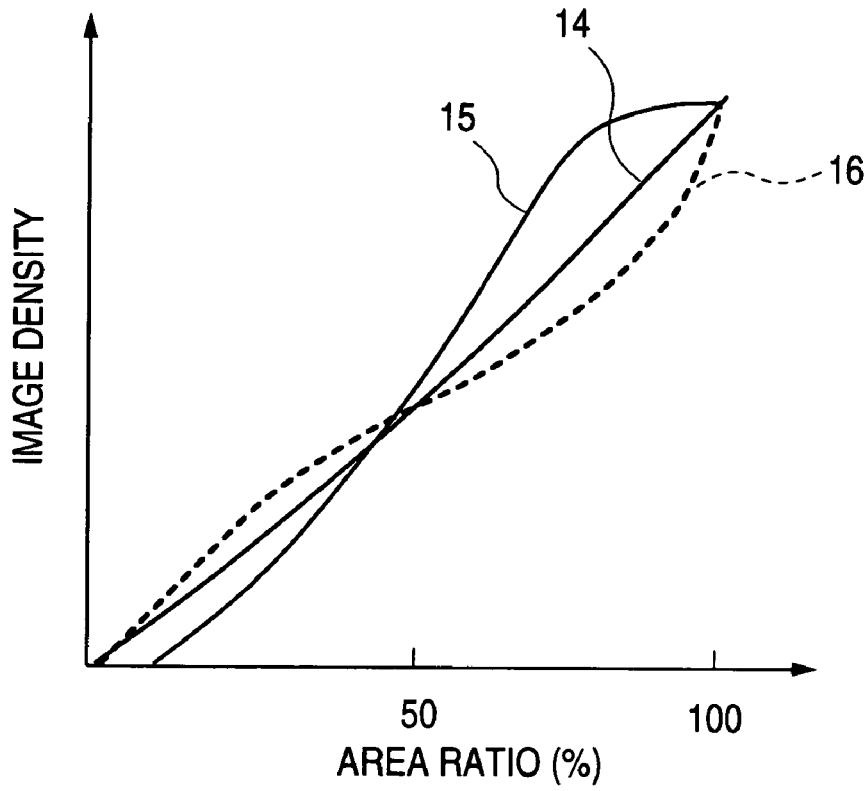
FIG. 4 is a characteristic curve showing the gradation density curve in the case where the image density of solid area is controlled to be constant by adjusting the developing bias when the developing gap is varied.

FIG. 4 is a gradation density curve in the case where the image density of a solid area (area ratio 100%) is controlled to be constant by adjusting a developing potential difference by changing the developing bias when the developing gap is varied. When the developing bias is varied, the image density of the solid image (area ratio 100%) can be corrected by changing the developing bias and adjusting the developing potential difference, but the variation in the gradation density curve can not be corrected. This is due to the fact that a ratio of the strength of developing electric field occurring in developing the solid image to that of developing electric field occurring in developing the mesh point or line image is changed, when the developing gap is varied.

Figure 5:
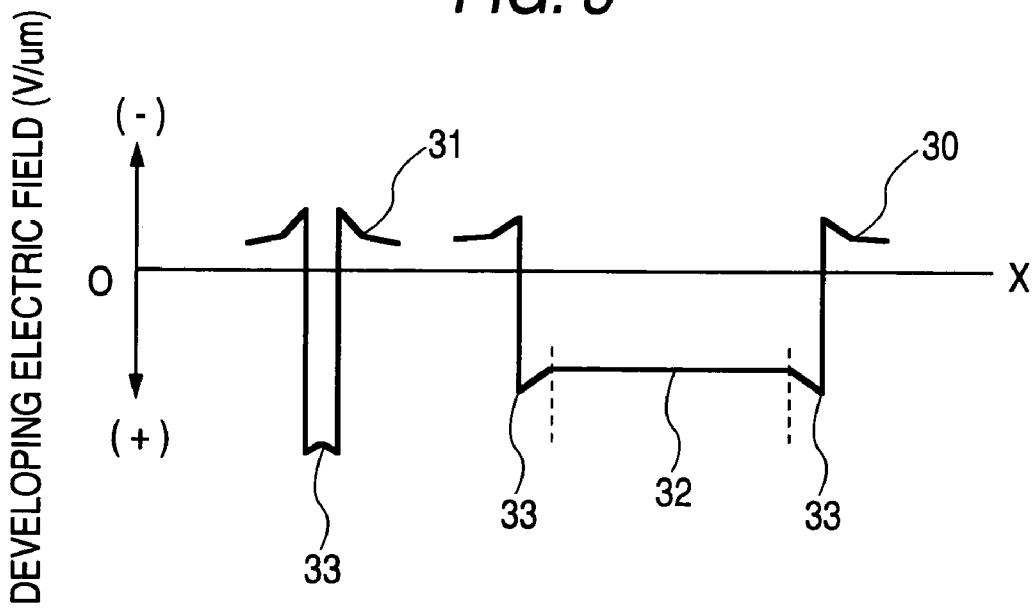
FIG. 5 is a diagram schematically showing a developing electric field occurring when the solid image is developed and a developing electric field occurring when the mesh point or line image is developed.

FIG. 5 is a diagram schematically showing a developing electric field occurring in developing the solid image and a developing electric field occurring in developing the mesh point or line image, in which the position on the photoconductor is taken along the transverse axis. Reference numeral 30 denotes a developing electric field occurring in developing the solid image, and reference numeral 31 denotes a developing electric field occurring in developing the mesh point or line image.

The interior of solid image is the area not affected by the peripheral effect of electric field, in which the developing electric field occurring in this area is referred to as a parallel electric field, and denoted by reference numeral 32 in FIG. 5. On the other hand, an end portion of the solid image and the mesh point or line image are affected by the peripheral effect of electric field, in which a stronger electric field than the parallel electric field occurs. The developing electric field occurring at the end portion of this solid image and the mesh point or line image is referred to as a peripheral electric field, and denoted by reference numeral 33 in FIG. 5. Owing to this peripheral electric field, more toner is developed at the mesh point or line image than the interior of solid image. A change in the ratio of peripheral electric field strength to parallel electric field strength may occur due to resistance of the developer, and a change with the passage of time in the film thickness of photoconductor, in addition to the developing gap.

In this invention, the interior of solid image mainly subjected to parallel electric field and the end portion of solid image and the mesh point or line image mainly subjected to peripheral electric field are exposed to light at different quantities of light to control the parallel electric field strength and the peripheral electric field strength separately.

More specifically, an image signal is read into memory before exposure, and a portion having a predetermined number of pixels adjacent to the white paper portion of the entire image is detected by a pattern matching method. And the portion having predetermined number of pixels adjacent to the white paper portion is exposed to light at an exposure value E2, or the other portion is exposed at an exposure value E1. The predetermined number of pixels adjacent to the white paper portion is set below the number of pixels corresponding to the width of peripheral electric field occurring at the end portion of solid image. In this embodiment, the peripheral electric field occurs over a width of about 200 μm at the end portion of solid image, corresponding to the number of pixels of about 5 dots at a resolution of 600 dpi.

To make the peripheral electric field with the same strength as the parallel electric field, it is required that the number of pixels of 5 dots where the peripheral electric field occurs is changed to the predetermined number of pixels. However, the experiments have revealed that the image quality of mesh point or line image is stabilized below the predetermined number of pixels to correct for a variation in the peripheral electric field. In this embodiment, the predetermined number of pixels adjacent to the white paper portion is set to 2 dots.

Figure 6:
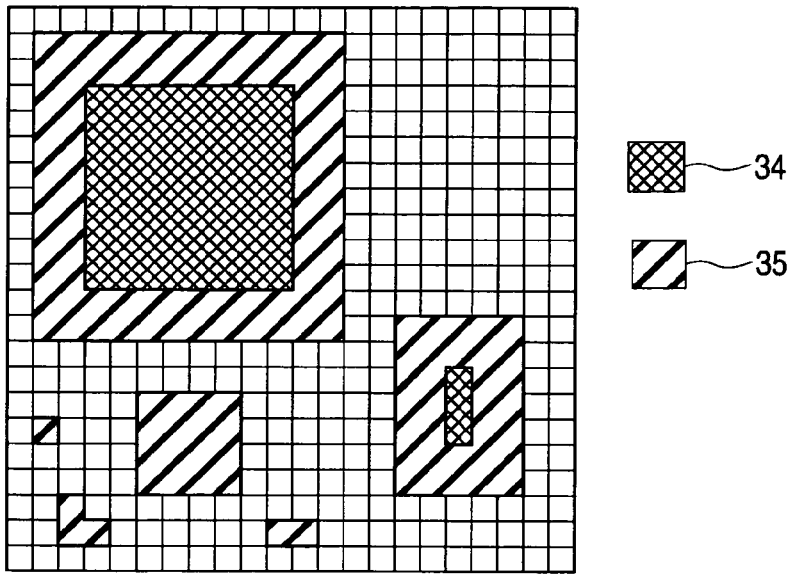
FIG. 6 is an explanatory view showing a portion having a width of two dots adjacent to the white paper portion, and the other portion, when a random image pattern is employed.

FIG. 6 is an explanatory view showing a portion having a width of two dots adjacent to the detected white paper portion, which is designated by reference numeral 35, and the other portion which is designated by reference numeral 34, when a random image pattern is employed. The portion 35 having a width of two dots adjacent to the detected white paper portion consists of an area having a smaller width of image and the end portion of solid image, in which the peripheral electric field is predominant.

Figure 7:
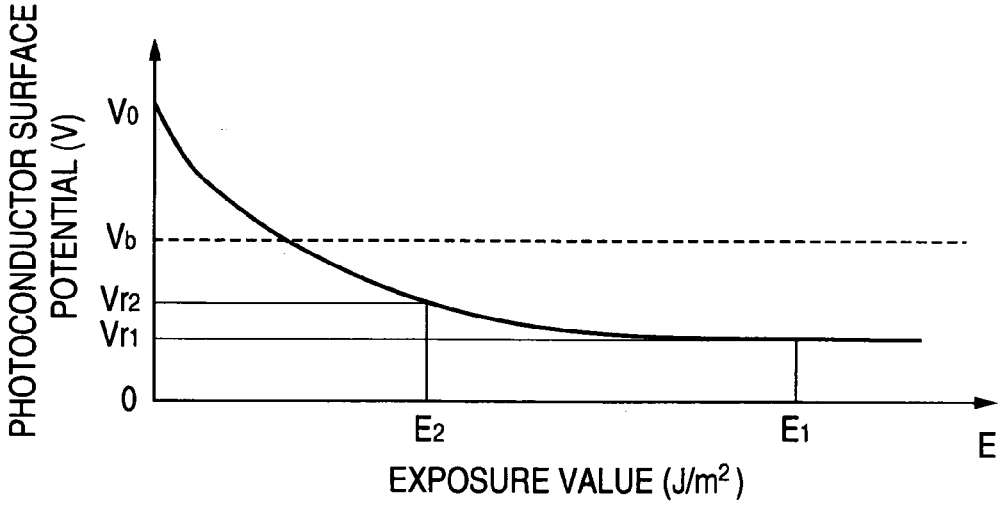
FIG. 7 is an explanatory view showing a light response characteristic of the photographic drum.

The relationship between exposure values E1 and E2 will be described below. FIG. 7 is an explanatory view showing a light response characteristic of the photographic drum 1. The transverse axis represents the exposure value E in terms of light energy input into the photographic drum 1. The longitudinal axis represents the surface potential of the photographic drum 1 for a fixed time after exposure.

Reference V0 on the longitudinal axis denotes a background potential in the development. Vr1 on the longitudinal axis denotes the potential on the photoconductor 1 corresponding to the exposure value E1, and Vr2 denotes the potential on the photoconductor 1 corresponding to the exposure value E2. Vb denotes abias voltage of the developing unit, and Vb-Vr1, Vb-Vr2 denote developing potential differences. That is, Vb-Vr2 is used for the developing potential at the end portion of solid image, the line image or mesh point on which the peripheral effect of electric field strongly acts, and Vb-Vr1 is used for the developing potential in the solid area (solid image).

An instance where a variation in the gradation density curve when the developing gap is dispersed between each image forming means is corrected by adjusting the DC voltage of developing bias and the quantity of light for exposing the image area having a width of a few dots adjacent to the white paper portion will be described below.

Figure 8:
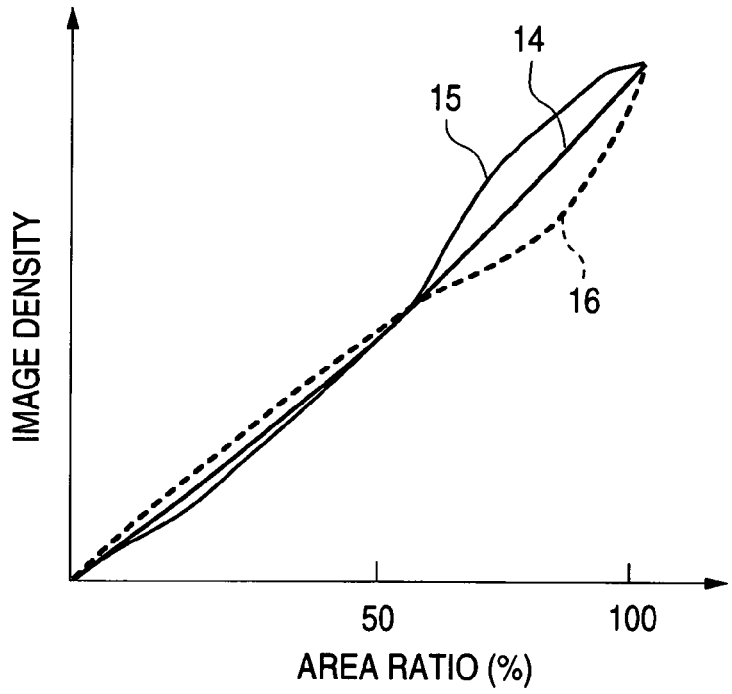
FIG. 8 is a characteristic curve showing the gradation density curve in the case where the gradation density curve is corrected by adjusting the developing bias (DC voltage), the photoconductor surface potential, and the quantity of light for exposing the image area having a width of a few dots adjacent to the white paper portion.

FIG. 8 is a gradation density curve which is corrected in such a way that a test patch image of an image (solid image) developed by parallel electric field is detected by the image density sensor, in which the DC voltage of developing bias is adjusted so that the detected image density may be set to the preset value, and the test patch image of image (mesh point image having an area ratio of 50%) developed on the photoconductor under the peripheral electric field is detected by the image density sensor, while the conditions for the DC voltage of developing bias are maintained, in which the exposure value E2 for exposing the image area having a width of a few dots adjacent to the white paper portion is adjusted so that the detected density may be set to the preset value.

In FIG. 8, a curve 14 is a gradation density curve when the developing gap is proper, a curve 15 is a gradation density curve when the developing gap is narrower than the proper value, and a curve 16 is a gradation density curve when the developing gap is wider than the proper value.

With this control method, when the developing gap is dispersed, the gradation density curve for the density of image having an area ratio of 100% (solid image) or a low area ratio of 50% or less is corrected, but the gradation density curve for the density of image having a high area ratio of more than 50% is not sufficiently corrected.

Figure 9:
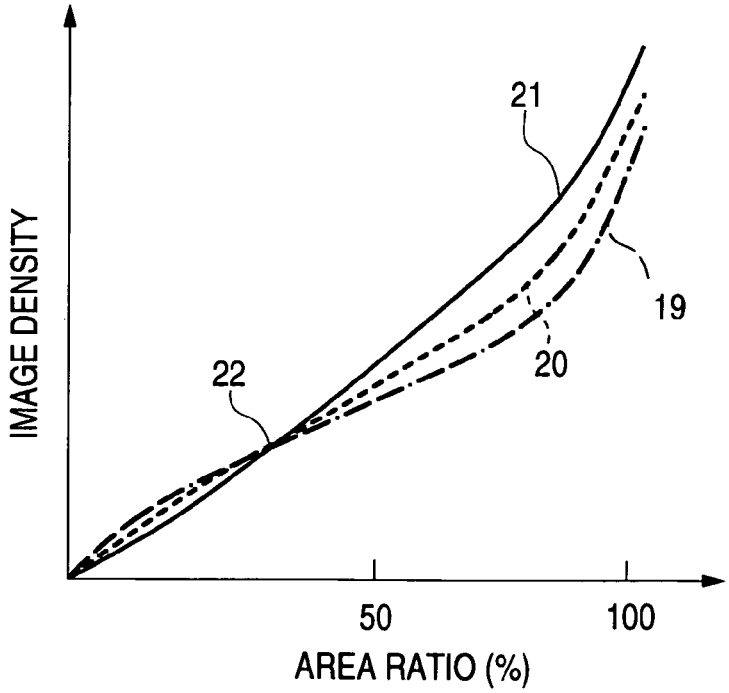
FIG. 9 is a characteristic curve showing a comparison between the gradation density curves when a developing bias of DC voltage alone is applied and when a developing bias with an AC voltage superposed on the DC voltage is applied.

The influence on the gradation density curve exerted by the AC voltage superposed for the developing bias will be described below. In FIG. 9, the gradation density curves are shown for comparison between a case where the developing bias of DC bias alone is applied and a case where the developing bias with the AC voltage superposed on DC voltage is applied.

In FIG. 9, a curve 19 is the gradation density curve when the developing bias of DC voltage alone is applied and the curves 20, 21 are gradation density curves when the developing bias with AC voltage superposed on DC voltage is applied. Herein, a curve 21 has a greater amplitude Vpp of AC voltage than a curve 20. A point 22 is a point of intersection between the gradation density curve 19 when the developing bias of DC voltage alone is applied and the gradation density curves 20, 21 when the developing bias with AC voltage superposed on DC voltage is applied.

When the developing bias with AC voltage superposed on DC voltage is applied, the image density of the solid image having an area ratio of 100% is not only increased, but also the developing ability of the image having a relatively large area ratio is increased, and the developing ability of the image having a small area ratio is decreased, whereby the gradient of the gradation density curve is changed. When the developing bias with AC voltage superposed on DC voltage is applied, the percentage of change in the gradient of the gradation density curve is increased as the amplitude Vpp of AC voltage is greater. That is, the percentage of change in the gradient of the gradation density curve is greater for the curve 21 than the curve 20.

The image area ratio at the point 22, at which the gradation density curve 19 when the developing bias with DC voltage alone is applied and the gradation density curves 20, 21 when the developing bias with AC voltage superposed is applied intersect, is determined by the relationship between the DC voltage Vb of developing bias and the potential latent image on the photoconductor. When a developing potential difference and a background potential difference are equal, the point 22 of intersection takes place at the point where the area ratio of image is about 50%. Thereby, as the developing potential difference is greater than the background potential difference, the point 22 of intersection is shifted toward the lower area ratio. For example, when the charging voltage is −600V, the discharging voltage is −50V, and the DC voltage vb of developing bias is −400V, the point 22 of intersection takes place at the point where the area ratio is about 30%. In the portion of image having a relatively small area ratio of 50% or less, since the development under the peripheral electric field is essentially predominant, the change of image density is small when the amplitude Vpp of AC voltage is changed. On the other hand, in the portion of image having a relatively large area ratio of 50% or more, the change of image density is great when the amplitude Vpp of AC voltage is changed.

A method for correcting the gradation density curve according to this invention will be described below.

(Procedure 1)

First of all, several test patch latent images of solid images are formed on the photoconductor at a fixed exposure value E1 under the condition where the amplitude of AC voltage is Vpp (design center value at the start time of control).

While a difference between the DC voltage vb of developing bias and the grid voltage Vg of the Scorotron charger is kept at 150V, for example, the DC voltage Vb of developing bias and the grid voltage vg of the charger are changed at several points every 50V to develop the test patch latent images and produce the test patch images.

Figure 10:
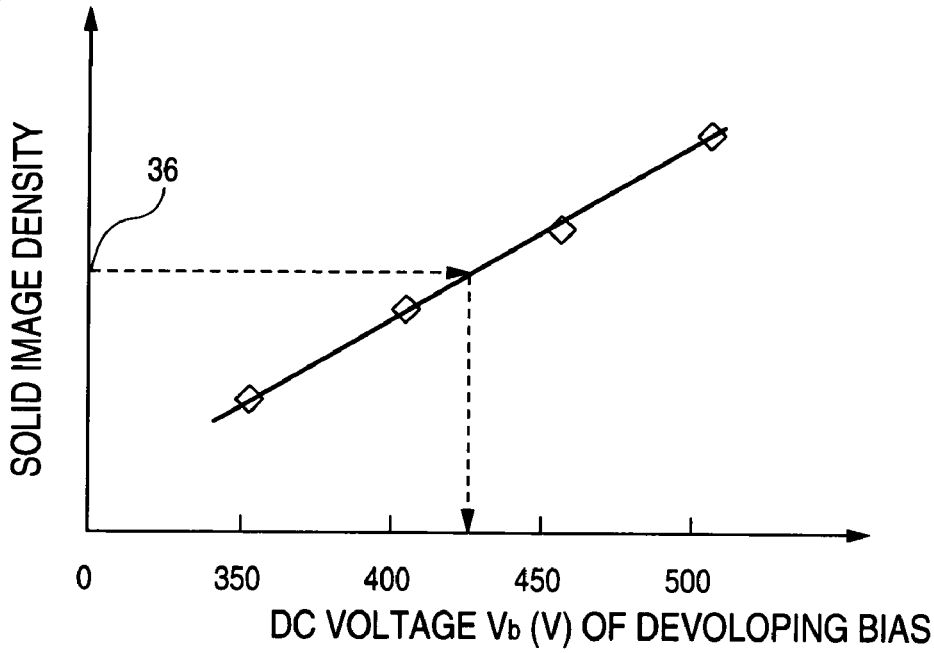
FIG. 10 is an explanatory diagram showing a relationship between the DC voltage Vb of developing bias and the solid image density, which is obtained by detecting the test patch image.

Then, the image density inside the test patch image of solid image (area developed under the parallel electric field) is measured, employing the optical image density sensor 10, thereby obtaining the relation between the DC voltage Vb of developing bias and the solid image density as shown in FIG. 10. From FIG. 10, the value of the DC voltage Vb of developing bias that has a target solid image density 36 is determined by the linear approximation. The grid potential Vg of the Scorotron charger is determined at Vb+150V.

(Procedure 2)

Figure 11:
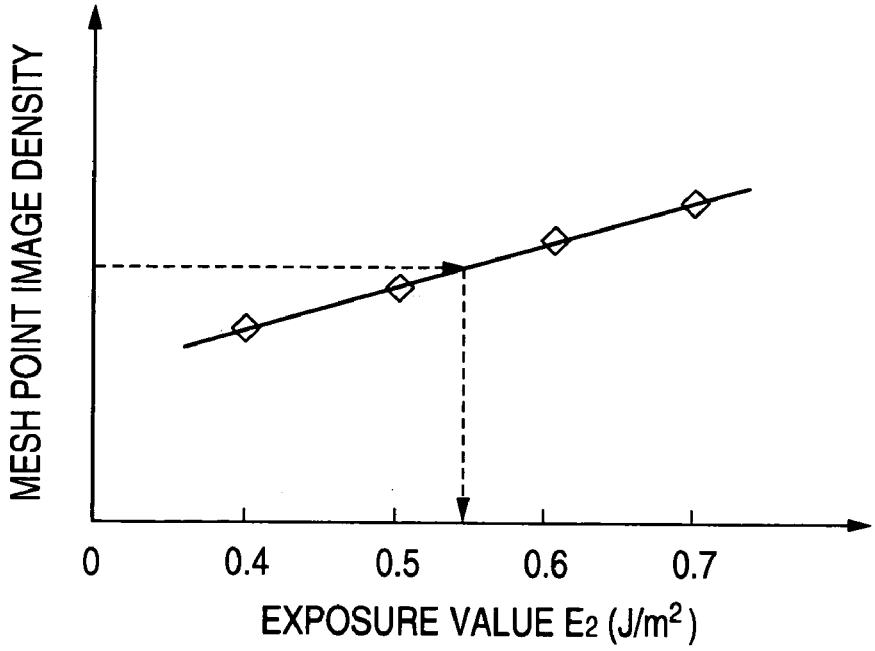
FIG. 11 is an explanatory view showing a relationship between the exposure value E2 and the mesh point image density obtained by detecting the test patch image.

Under the conditions with the DC voltage Vb of developing bias determined in accordance with procedure 1 and the grid potential vg of the Scorotron charger, several test patch latent images that are mainly developed under the peripheral electric field are formed on the photoconductor, while the exposure value E2 is being changed. For the test patch latent images, the mesh point images having a fixed area ratio (e.g., area ratio of 50% or less) are employed. The test patch latent images are developed to produce the test patch images. Then, the image density of the test patch images is measured, employing the optical image density sensor 10, to obtain the relation between the exposure value E2 and the image density of mesh point, as shown in FIG. 11. From FIG. 11, the value of the exposure value E2 that has a target mesh point image density 37 is determined by the linear approximation.

(Procedure 3)

Under the conditions with the DC voltage vb of developing bias determined in accordance with the procedures 1 and 2, the grid potential Vg of the Scorotron charger, and the exposure value E2, a test patch latent image that is a mesh point image with an image area ratio of 70% is formed, and developed to produce a test patch image. Then, the image density of the test patch image of the mesh point image is measured, employing the optical image density sensor 10, and compared with a preset range of image density.

(Procedure 4)

If the image density of the mesh point having an image area ratio of 70% falls within a predetermined range of image density, the control is ended. On the other hand, if the image density of the mesh point with an image area ratio of 70% is below the predetermined range of image density, the amplitude Vpp of AC voltage is increased, or conversely if the image density of the mesh point with an image area ratio of 70% is above the predetermined range of image density, the amplitude Vpp of AC voltage is decreased.

The procedures 1 to 4 are repeated until the image density of the mesh point with an image area ratio of 70% falls within the predetermined range of image density in procedure 4.

The change width of the amplitude Vpp of AC voltage in accordance with procedure 4 is determined based on the preset change width of the amplitude Vpp of AC voltage and data of percentage of change in the image density, which is obtained beforehand, so that the image density of the mesh point with an image area ratio of 70% is converged more rapidly within the predetermined range of image density.

Figure 12:
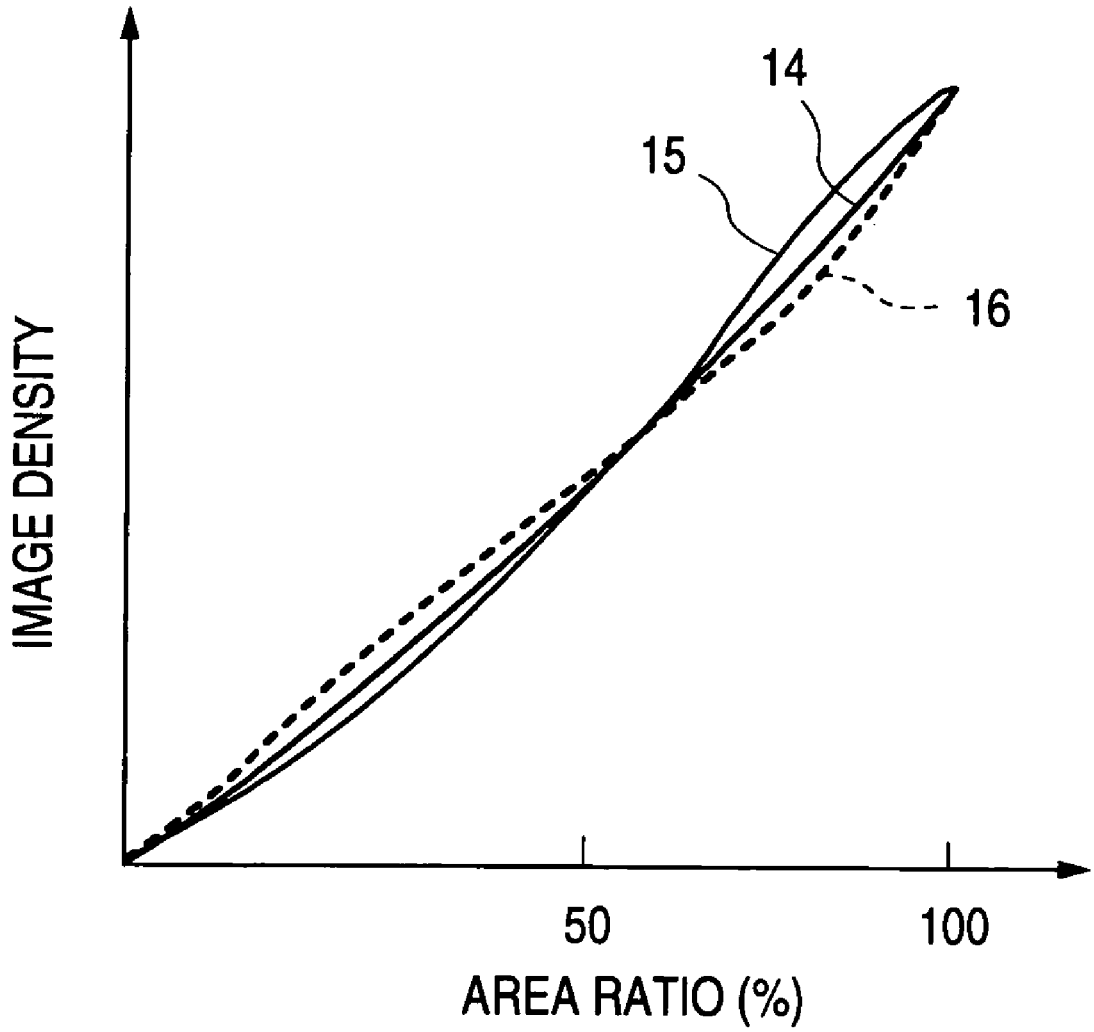
FIG. 12 is a characteristic curve showing the gradation density curve when the gradation density curve is corrected according to the invention.

FIG. 12 is a gradation density curve which is corrected using the control method of this invention. According to this invention, a variation in the gradation density curve caused by a variation in the peripheral electric field can be corrected for each image forming means.

Also, in the previous embodiment, the image density of the mesh point with an image area ratio of 70% is adjusted within the predetermined range of image density. However, the same effect is attained, so far as the image area ratio used herein is the area ratio (50% or more, preferably 60 to 80%) that is greatly varied when the developing gap is varied.

The gradation density curve of correction target for each image forming means will be described below.

A method may be taken in which the gradation density curve of correction target is given beforehand, and the gradation density curve of each image forming means is matched with the given gradation density curve. With this method, when the variation factors (developing gap, developer resistance, film thickness of photoconductor) of the peripheral electric field for each image forming means are greatly changed in the same direction, the adjustment parameters (DC voltage Vb of developing bias, amplitude Vpp of AC voltage) may be likely to reach the limit values in the variable range thereof, lowering the productivity of printed matter due to an uncontrollable error.

Even when the gradation density curve is changed in the tendency, the hue of the color image obtained by color superposition is only changed in the L* direction in the L*a*b* color coordinate system, if the gradation density curve of each image forming means is matched. That is, the tint is not changed, but the color luminosity is only changed. A deviation of the hue in the L* direction is easily corrected by manipulating the area ratio of mesh point area gradation allocated to the input image data of continuous gradation at the time of raster expansion, so far as the gradation density curve has already known tendency, even though the hue of an output test pattern is not read into the control portion of the image forming apparatus by the scanner.

Therefore, the gradation density curve of correction target is not predetermined, but the optical image density sensor 10 senses the tendency of the gradation density curve for each of the image forming means 102 to 105, and an overall control portion 127 compares the image density information of the total gradation density curve for the image forming means 102 to 105, whereby the gradation density curve of correction target is set up in a correctable range of the gradation density curve by each of the image forming means 102 to 105. In this manner, it is possible to prevent the productivity from lowering due to uncontrollable error because the adjustment parameters (DC voltage Vb of developing bias, amplitude Vpp of AC voltage) reach the limit values in the variable ranges. Also, it is possible to prevent the productivity of printed matter from lowering because the normal print job is stopped to output the test pattern.

Figure 13:
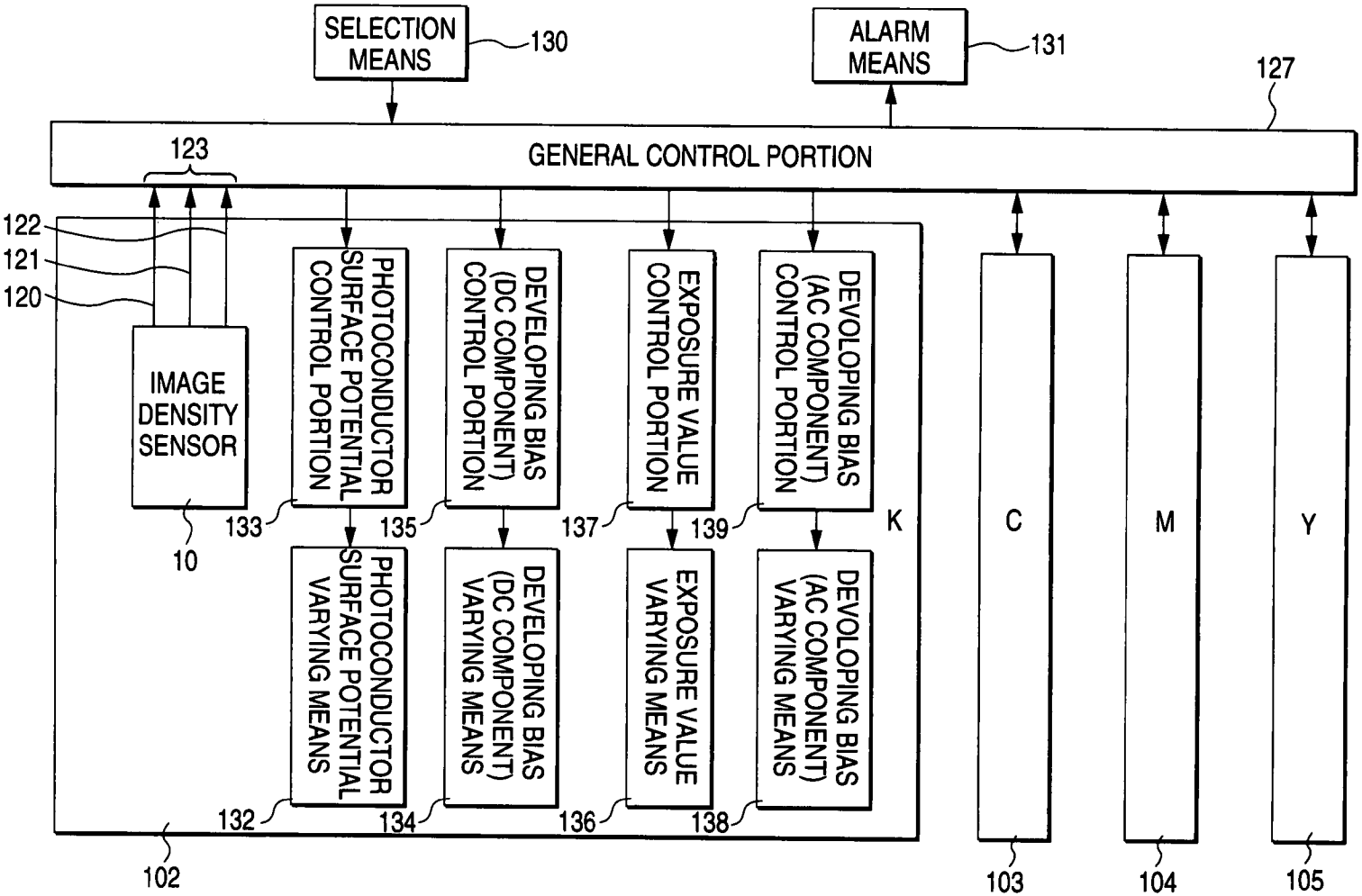
FIG. 13 is a control block diagram of the color image forming apparatus according to the invention.

FIG. 13 is a control block diagram of the color image forming apparatus. As shown in FIG. 13, each of the image forming means 102 to 105 (black image forming means 102 is shown in the figure, but other image forming means 103 to 105 have the same constitution) is provided with the image density sensor 10, a photoconductor surface potential control portion 133 for controlling photoconductor surface potential varying means 132, a developing bias (DC component) control portion 135 for controlling developing bias (DC component) varying means 134, an exposure value control portion 137 for controlling exposure value varying means 136, and a developing bias (AC component) control portion 139 for controlling developing bias (AC component) varying means 138.

And the image density information 120 of image developed by parallel electric field, the image density information 121 of image developed by peripheral electric field, and the image density information 122 of intermediate image having an area ratio of 50 to 100% are unified into the image density information 123 for the total gradation density curve, which is then input into the overall control portion 127. The overall control portion 127 compares the image density information 123 from the image forming means 102 to 105, and determines the gradation density curve of correction target within the correctable range of the gradation density curve by each of the image forming means 102 to 105.

The photoconductor surface potential is adjusted via the photoconductor surface potential varying means 132 by the photoconductor surface potential control portion 133, the DC component of developing bias is adjusted via the developing bias varying means 134 by the developing bias control portion 135, the exposure value is adjusted via the exposure value varying means 136 by the exposure value control portion 137, and the amplitude of AC component of developing bias is adjusted via the developing bias varying means 138 by the developing bias control portion 139, so that there may be small differences in the gradation density curve for the image forming means 102 to 105. Herein, at least one, or preferable two or more, of the photoconductor surface potential, the DC component of developing bias, the exposure value and the amplitude of AC component of developing bias are adjusted.

The color image forming apparatus according to the embodiment of the invention is provided with selection means 130 for enabling the user to select in advance whether the printing is stopped or continued, when an uncontrollable error occurs, as shown in FIG. 13.

Under the above control performed for each of the image forming means, if the gradation density curve is not converged into the gradation density curve of correction target, even though the adjustment parameters (DC voltage Vb of developing bias, amplitude Vpp of AC voltage) reach the upper limits or the lower limits in the preset variable range thereof, the adjustment parameters are set to the upper limits or lower limits in the variable range where the image density of control object is closest to the target range, and alarm means 131 raises the alarm indicating that the corresponding image forming means is abnormal. This alarm means is composed of voice generating means and liquid crystal display means, for example.

When the alarm is raised, the user makes a selection of whether the printing is stopped or continued, based on the selection means 130. In this manner, it is possible to prevent the productivity of printed matter from lowering for the user tolerating more or less change in the hue of the color image.

The printing control as described above is performed periodically at the proper time during the manufacture of the apparatus, after the work having the possibility that the developing gap is varied (e.g., exchange or repair of the developing unit), when and after the power of the image forming apparatus is turned on, and when the printing job pauses, whereby it is possible to reduce variations in the hue of the color image without lowering the productivity of printed matter.

What is claimed is:

1. A color image forming apparatus comprising:

a plurality of image forming devices each comprising:

a photoconductor;

a charger for charging the surface of said photoconductor;

an exposing unit for exposing the charged surface of said photoconductor to form an electrostatic latent image;

a developing unit for developing said electrostatic latent image on said photoconductor by attaching a toner on said photoconductor with a developer carrier to which a developing bias with an AC component superposed is applied;

an image density sensor for sensing an image density of an image developed by said developing unit;

a developing bias DC component control portion for controlling a DC component of a developing bias applied to said developing unit based on the image density information that the image density of the image developed on said photoconductor due to a parallel electric field is sensed by said image density sensor;

a photoconductor surface potential control portion for controlling a surface potential of said photoconductor based on the image density information that the image density of the image developed on said photoconductor due to a parallel electric field is sensed by said image density sensor;

an exposure value control portion for controlling an exposure value of said exposure unit based on the image density information that the image density of the image developed on said photoconductor due to a peripheral electric field is sensed by said image density sensor;

a developing bias AC component control portion for controlling the amplitude of AC component of a developing bias applied to said developing unit based on the image density information that the image density having a dot occupied area ratio of 50% or more is sensed by said image density sensor; and an exposure value varying unit for switching an exposure value of said exposure unit between an image area having a predetermined number of pixels adjacent to a white paper portion and other image areas;

wherein at least one of a DC component of developing bias by said developing bias DC component control portion, a surface potential of said photoconductor by said photoconductor surface potential control portion, an exposure value by said exposure value control portion, and the amplitude of a developing bias AC component by said developing bias AC component control portion is adjusted to reduce a difference in a gradation density curve between each image forming devices.

2. The color image forming apparatus according to claim 1, further comprising an alarm unit for alarming that each of said image forming devices is abnormal, and a selection unit for selecting whether the printing is stopped or continued at the time of alarming, characterized in that when the detected density of a solid image having a dot occupancy ratio of 100% and a mesh point image having a dot occupancy ratio of 60 to 80% is not converged into a target image density range, even though the DC component of developing bias or the amplitude of AC component reaches an upper limit or a lower limit in a preset variable range, the DC component of developing bias and the amplitude of AC component are set to an upper limit or lower limit value in a preset variable range where the detected density of said solid image and said mesh point image are closest to the target image density range, and said alarm unit alarms that the corresponding image forming device is abnormal., whereby the printing is stopped or continued in accordance with the selected content of said selection unit.

* * * * *